US011649734B1

(12) United States Patent
Menheere

(10) Patent No.: US 11,649,734 B1
(45) Date of Patent: May 16, 2023

(54) VARIABLE GUIDE VANE CONTROL SYSTEM

(71) Applicant: PRATT & WHITNEY CANADA CORP., Longueuil (CA)

(72) Inventor: David Menheere, Norval (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/661,148

(22) Filed: Apr. 28, 2022

(51) Int. Cl.
*F01D 17/00* (2006.01)
*F01D 17/16* (2006.01)

(52) U.S. Cl.
CPC ..... *F01D 17/00* (2013.01); *F01D 17/16* (2013.01); *F01D 17/165* (2013.01); *F05D 2220/30* (2013.01)

(58) Field of Classification Search
CPC ..... F01D 17/00; F01D 17/16; F01D 17/162; F01D 17/165
See application file for complete search history.

(56) References Cited

U.S. PATENT DOCUMENTS 4,264,270 A 4/1981 Geary, Jr.
6,779,971 B2 8/2004 Garrett
10,669,882 B2 6/2020 Nakayama et al.

*Primary Examiner* — Christopher R Legendre
(74) *Attorney, Agent, or Firm* — Norton Rose Fulbright Canada LLP

(57) ABSTRACT

A variable guide vane control system comprises an actuator and a rolling contact joint. The joint includes a drive ring rotatable about a drive axis and at least one roller rotatable about a roller axis parallel to the drive axis and drivingly connectable to a vane. A first flexible member and a second flexible member connect the drive ring and the roller to one another. The first flexible member and the second flexible member are respectively tensioned when the drive ring rotates about the drive axis in a first direction and in a second direction opposite the first direction.

19 Claims, 9 Drawing Sheets

VARIABLE GUIDE VANE CONTROL SYSTEM

TECHNICAL FIELD

The disclosure relates generally to variable guide vanes and, more particularly, to variable guide vane control systems.

BACKGROUND

Turbine engines sometimes have variable guide vanes (VGVs) disposed in an inlet section, a compressor section or a turbine section. An angular orientation of the guide vanes are adjustable relative to a gas path in order to control the flow being directed through the gas path. An actuator positioned outside the gas path is conventionally used to actuate adjustment of the angular orientation of the VGVs. Control of the angular orientation of the VGVs remains a challenge.

SUMMARY

In accordance with a general aspect, there is provided a variable guide vane control system for a turbine engine having at least one vane rotatable about a vane axis, the system comprising: an actuator; and a rolling contact joint including: a drive ring rotatable about a drive axis and rotatably coupled to the actuator, at least one roller rotatable about a roller axis parallel to the drive axis and drivingly connectable to the at least one vane, and a first flexible member and a second flexible member tethering the drive ring and the at least one roller to one another, the first flexible member and the second flexible member respectively tensioned when the drive ring rotates about the drive axis in a first direction and in a second direction opposite the first direction.

In accordance with another aspect, there is provided a turbine engine comprising: a duct defining a gas path; at least one vane rotatably connected relative to the duct so as to extend in the gas path and be rotatable about a vane axis between a first vane position and a second vane position relative to the gas path; an actuator; and a rolling contact joint including: a drive ring rotatable about a drive axis and rotatably coupled to the actuator, at least one roller rotatable about a roller axis parallel to the drive axis and drivingly connected to the at least one vane, and a first flexible member and a second flexible member tethering the drive ring and the at least one roller to one another, the first flexible member and the second flexible member respectively tensioned when the drive ring rotates about the drive axis in a first direction and in a second direction opposite the first direction.

In accordance with a still further general aspect, there is provided a method of controlling rotation of at least one vane about a vane axis, the method comprising: rotating a drive ring about a drive axis; transmitting a rotation of the drive ring to at least one roller radially outward of the drive ring and rotatable about a roller axis parallel to the drive axis to rotate the at least one roller about the roller axis; transmitting a rotation of the at least one roller to the at least one vane to rotate the at least one vane about the vane axis; and opposing backlash between the transmitting the rotation of the drive ring to the at least one roller and the transmitting rotation of the at least one roller to the at least one vane.

BRIEF DESCRIPTION OF THE DRAWINGS

Reference is now made to the accompanying figures in which.

DETAILED DESCRIPTION

The terms "attached", "coupled", "connected", "engaged", "mounted" and other like terms as used herein may include both direct attachment, coupling, connection, engagement or mounting (in which two components contact each other) and indirect attachment, coupling, connection, engagement or mounting (in which at least one additional component is located between the two components).

The term "generally" and other like terms as used herein may be applied to modify any quantitative representation which could permissibly vary without resulting in a change in the basic function to which it is related.

Aspects of various embodiments will now be described through reference to the drawings.

Figure 1:
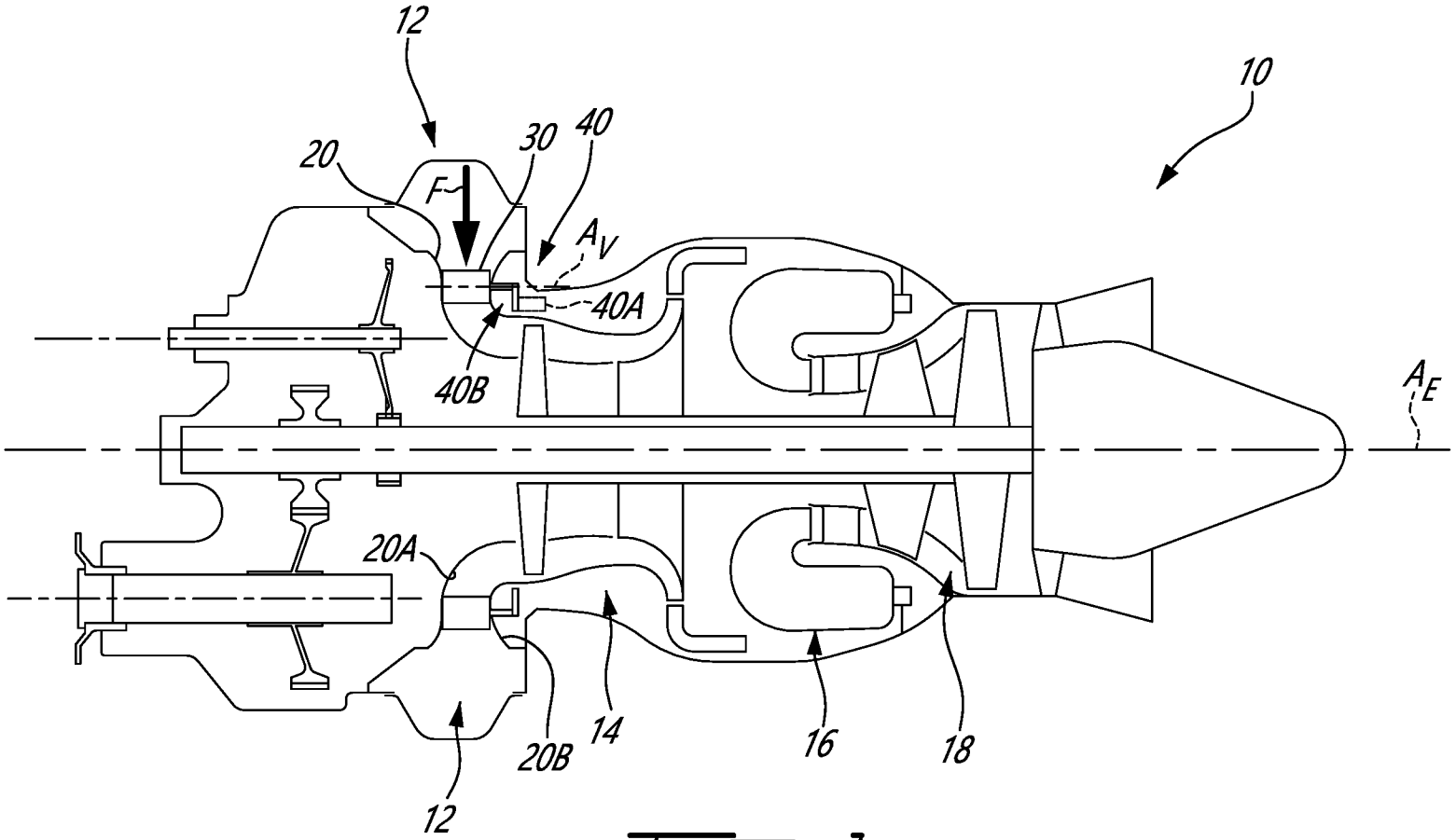
FIG. 1 is a schematic cross-sectional view of a turbine engine having a variable guide vane control system.

FIG. 1 illustrates a turbine engine 10 which may for example be part of an aircraft. Depending on the implementation of the present technology, the engine 10 could be any type of turbine engine including but not limited to a turbojet engine, a turbofan engine, a turboprop engine, and a turboshaft engine. In the illustrated example, the engine 10 is of the turboshaft type and generally comprises in serial flow communication an inlet section 12 for receiving air, a compressor section 14 for pressurizing the air, a combustor 16 in which the compressed air is mixed with fuel and ignited for generating an annular stream of hot combustion gases, and a turbine section 18 for extracting energy from the combustion gases. A flow path 20 of the engine 10 is defined by respective inner 20A and outer 20B walls of the inlet section 12, the compressor section 14 and the turbine section 18. The engine 10 may be provided with one or more arrays of variable guide vanes (VGVs, or vanes) 30 to locally regulate the fluid flow in the flow path 20. An array of vanes 30 corresponds to a plurality of vanes 30 circumferentially spaced apart from one another at a given axial location relative to a central axis $A_E$ of the engine 10. In the illustrated example, one such array of vanes 30 is provided in the inlet section 12. The vanes 30 in this case may thus be referred to as variable inlet guide vanes (or VIGVs). Each vane 30 of a given array of vanes 30 extends across the flow path 20 and is rotatably connected relative to at least one of the inner and outer walls 20A, 20B about a respective vane axis $A_V$ so as to be orientable relative to the flow path 20.

Rotation of each vane 30 of the array of vanes 30 about its respective vane axis $A_V$ is governed by a variable guide vane control system 40 (hereinafter "control system" 40) generally comprising an actuator 40A and rolling contact joints 40B operatively connecting the actuator 40A to the vanes 30 of a given array. Further details pertaining to the control system 40 will be provided hereinbelow.

Although the embodiment depicted in FIG. 1 shows that the engine 10 has a sole array of vanes 30 located in the inlet section 12, it shall be understood that depending on the embodiment, the engine 10 may include one or more arrays of vanes 30, one or more of which may be located elsewhere in the engine 10, for example upstream of a rotor of the compressor section 14 or upstream of a rotor of the turbine section 18. More than one array of vanes 30 may be provided in a given section 12, 14, 18 of the engine 10. In embodiments, the inlet section 20 is absent any vanes 30. The vanes 30 extend spanwise along their respective vane axis $A_V$ in an orientation that is generally transverse relative to a flow orientation of the flow path 20. Hence, the vane axes $A_V$ may extend spanwise at an angle relative to the central axis $A_E$ that is suitable for the shape and orientation of the flow path 20 at the location of the vanes 30. In the depicted embodiment, the vanes 30 are located in a portion of the flow path 20 defined by the inlet section 12 that extends generally radially relative to the central axis $A_E$, such that the vane axes $A_V$ are generally parallel to the central axis $A_E$ of the engine 10.

Figure 2:
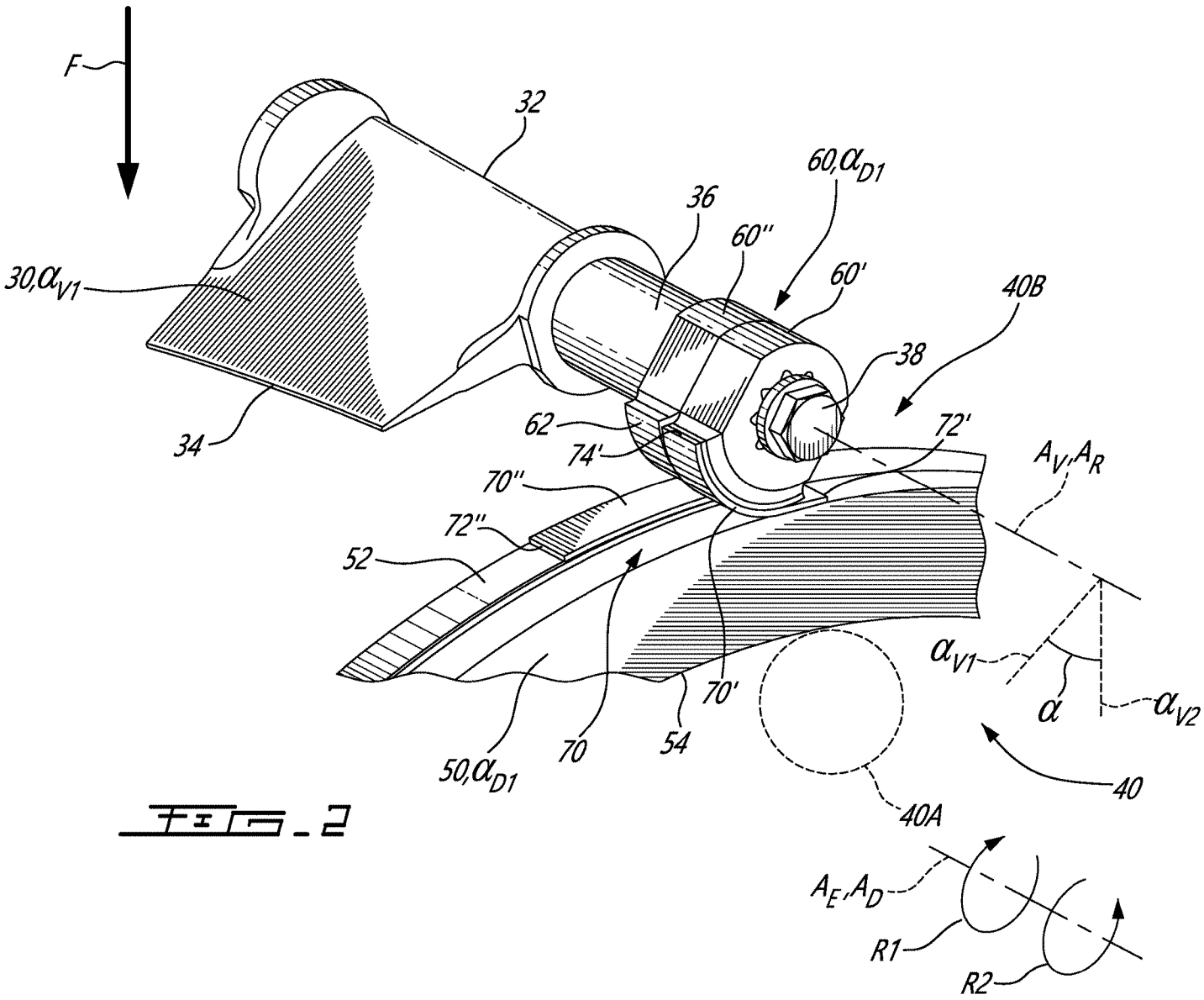
FIG. 2 is a perspective view of portions of the variable guide vane control system according to an embodiment.
Figure 3:
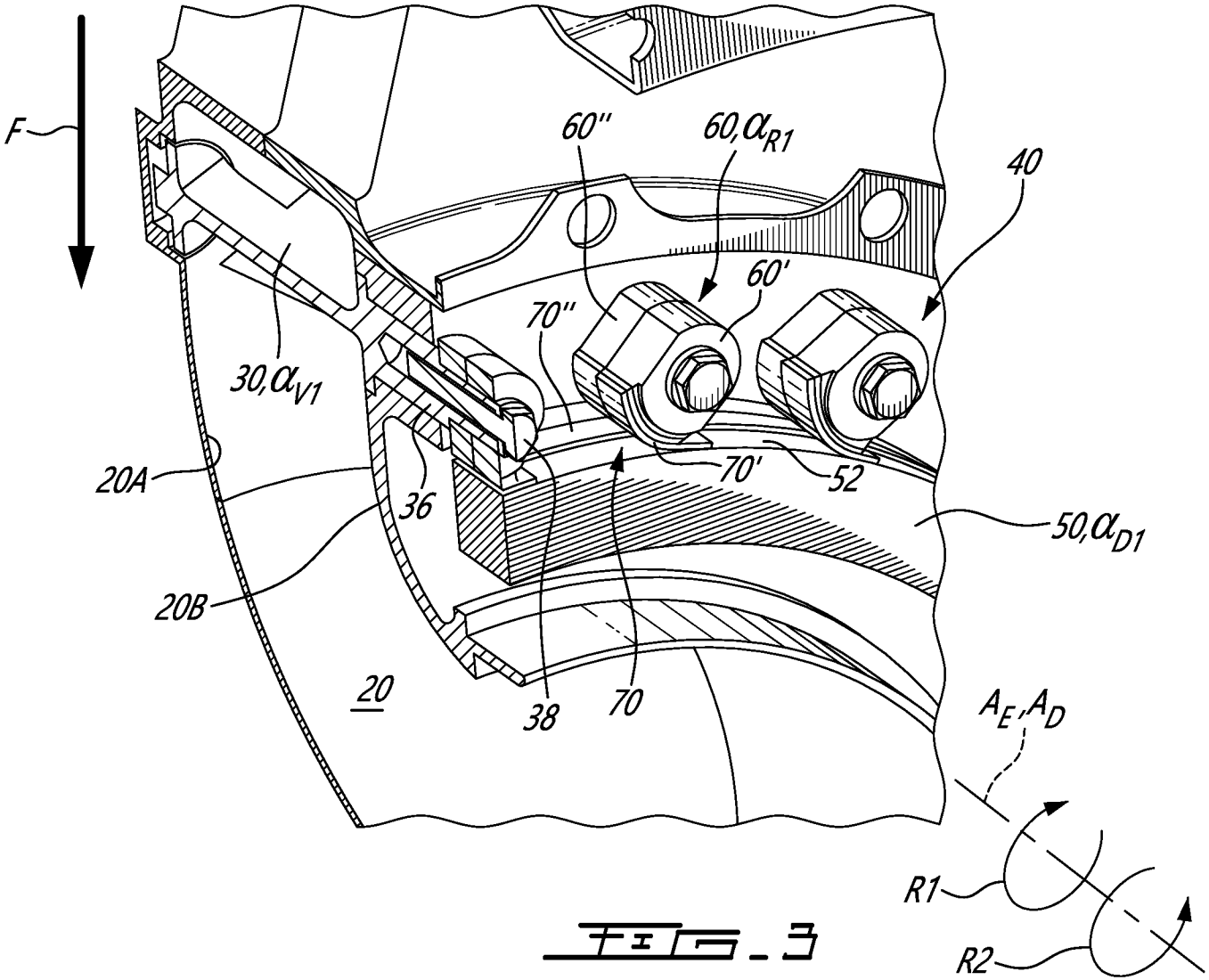
FIG. 3 is a perspective view of portions of the variable guide vane control system of FIG. 2, shown in a first position.
Figure 4:
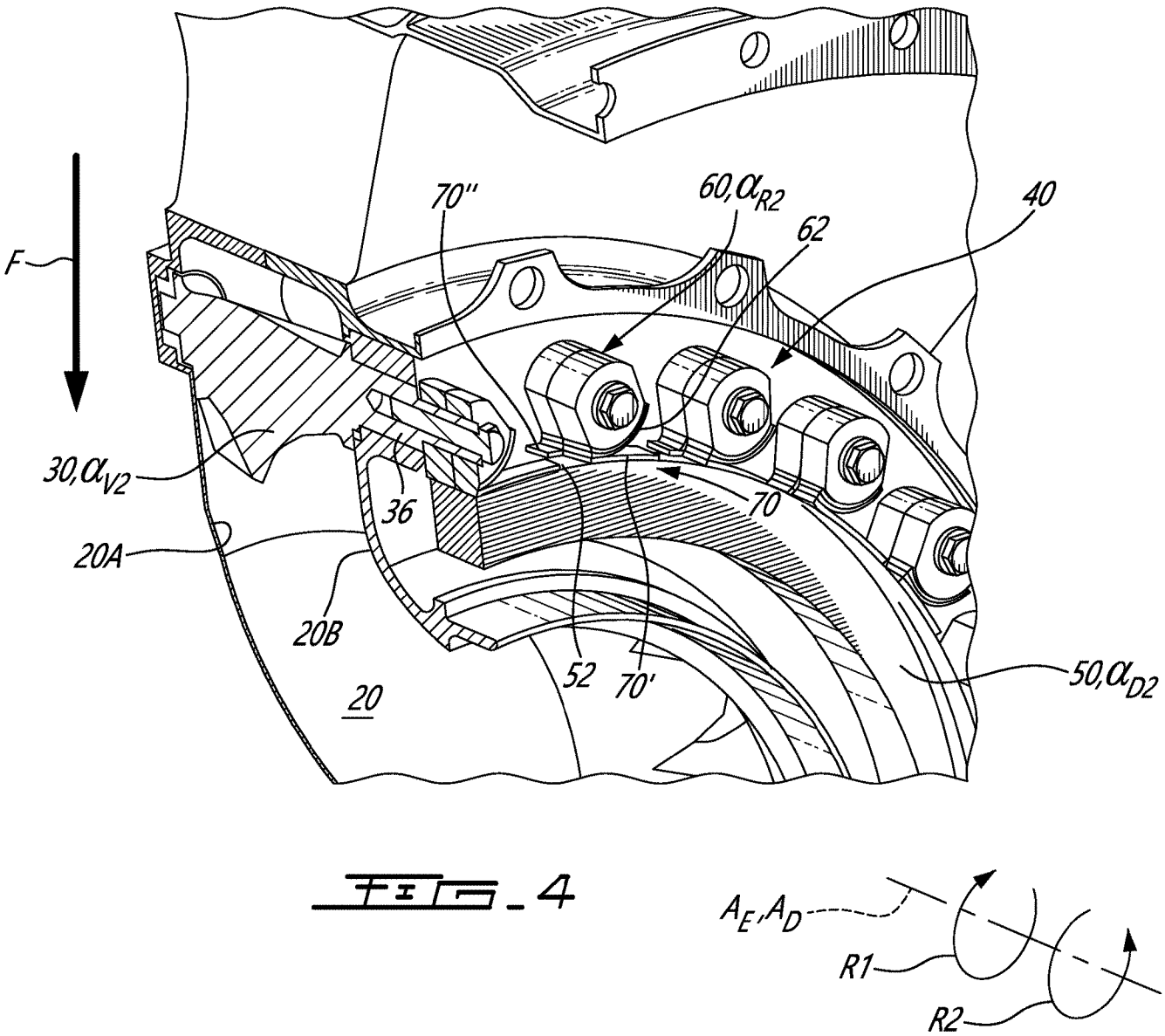
FIG. 4 is a perspective view of portions of the variable guide vane control system of FIG. 2, shown in a second position.

Referring to FIGS. 2 to 4, the control system 40 is a means suitable for selectively imparting rotation to the vanes 30 about their respective vane axes $A_V$ so as to position each vane 30 at a desired angular position or angle of attack $\alpha$ relative to a direction of the flow inside the flow path 20, schematically shown by arrow F. This angle of attack $\alpha$ is defined by a direction in which each vane 30 extends from its leading edge 32 to its trailing edge 34 (FIG. 2) relative to its vane axis $A_V$. In FIGS. 2 and 3, the vane 30 is shown in a first angular vane position $\alpha_{v1}$, whereas in FIG. 4, the vane 30 is shown in a second angular vane position $\alpha_{v2}$. The angle of attack $\alpha$ is greater in the first angular vane position $\alpha_{v1}$ than in the second angular vane position $\alpha_{v2}$, i.e., the vane 30 impinges the flow F more in the first angular vane position $\alpha_{v1}$ than in the second angular vane position $\alpha_{v2}$. In embodiments, the first and second vane positions $\alpha_{v1}$, $\alpha_{v2}$ may respectively correspond to closed and open positions of the vane 30 defining opposite boundaries, or maximum and minimum values, of a range of vane positions of the vane 30.

As mentioned hereinabove, the rotation of the vanes 30 is operated by the control system 40. The actuator 40A, in this case being of the hydraulic type, may otherwise be configured to be powered by any suitable power source. The actuator 40A has an end effector that is controllably movable from a first actuator position to a second actuator position, defining a range of actuator positions of the end effector. The rolling contact joints 40B interconnect the end effector of the actuator 40A and the vanes 30 such that moving the end effector from the first actuator position to the second actuator position moves the vane 30 from the first vane position $\alpha_{v1}$ to the second vane position $\alpha_{v2}$, and vice versa.

The rolling contact joints 40B share a common rolling element referred to henceforth as a drive ring 50, and respectively have a discrete rolling element referred to henceforth as a roller 60. The drive ring 50 and the rollers 60 are respectively rotatable about a drive axis $A_D$ and a roller axis $A_R$ that are parallel to one another. Each one of the rollers 60 is radially outward of the drive ring 50 relative to the drive axis $A_D$. Each roller 60 has an outer roller surface 62 extending circumferentially relative to the corresponding roller axis $A_R$ and circumscribed by an outermost diameter of the roller 60. The rollers 60 are individually rotatably coupled to the drive ring 50 such that rotating the drive ring 50 about the drive axis $A_D$ rotates all of the rollers 60 about their respective roller axis $A_R$. Stated otherwise, the drive ring 50 is drivingly connected to the rollers 60. The drive ring 50 is rotatably coupled to the end effector of the actuator 40A by a suitable means, such that the drive ring 50 is controllably rotatable about the drive axis $A_D$. In the depicted embodiments, the drive axis $A_D$ and the central axis $A_E$ of the engine 10 are colinear, although other arrangements are possible. The drive ring 50 may for example be an annular gear, i.e., a ring having an outer ring surface 52 and an inner ring surface 54 provided with teeth, and the end effector may be a pinion drivingly engaged with the inner ring surface 54. Each roller 60 is rotatably coupled to a given one of the vanes 30 by a suitable means, such that rotating a given roller 60 about its respective roller axis $A_R$ rotates the corresponding vane 30 about its respective vane axis $A_V$. Rotating the given roller 60 from a first roller position $\alpha_{R1}$ to a second roller position $\alpha_{R2}$ about its roller axis $A_R$ rotates the corresponding vane 30 about its vane axis $A_V$ from the first vane position $\alpha_{v1}$ to the second vane position $\alpha_{v2}$, and vice versa. In embodiments, the first and the second roller positions $\alpha_{R1}$, $\alpha_{R2}$ define boundaries of a range of roller positions of the rollers 60. Rotating the drive ring 50 about the drive axis $A_D$ from a first drive ring position $\alpha_{D1}$ to a second drive ring position $\alpha_{D2}$ rotates the given roller 60 about its roller axis $A_R$ from the first roller position $\alpha_{r1}$ to the second roller position $\alpha_{r1}$, and vice versa. In embodiments, the first and the second drive ring positions $\alpha_{D1}$, $\alpha_{D2}$ define boundaries of a range of ring positions of the drive ring 50.

In the depicted embodiments, the rollers 60 are drivingly connected to their respective vanes 30 in a direct manner, i.e., each roller 60 is mounted on a stem 36 of its corresponding vane 30. The stem 36 extends along the vane axis $A_V$ from inside the flow path 20 to outside thereof, in this case through the outer wall 20B. A peripheral surface of the stem 36 surrounding the vane axis $A_V$ defines an anti-rotational feature, or shape. The roller 60 has an inner wall surrounding the roller axis $A_R$ defining an opening and having a shape complementary to that of the anti-rotational feature of the stem 36, such that upon the roller 60 being mounted to the stem 36, the stem 36 is received by the opening and the anti-rotational feature and the inner wall cooperate so as to hinder rotation of the roller 60 and the stem 36 relative to one another about the roller axis $A_R$ and/or the vane axis $A_V$. Axial movement of the roller 60 with respect to the stem 36 relative to the roller axis $A_R$ may be hindered on either side by the wall 20A, 20B through which the stem 36 extends (in this case the outer wall 20B), and by a fastener 38 or other suitable means disposed at a distal end of the stem 36.

In other embodiments, the rollers 60 may be indirectly drivingly connected to their respective vanes 30. Each roller 60 may be mounted to, or form part of, a respective input shaft that is rotatably coupled to a corresponding one of the stems 36, for example by way of suitable gearing. In some such embodiments, the input shafts extend along the roller axes $A_E$, whereas the vane axes $A_V$ may be at an angle relative to their corresponding roller axes $A_R$ and to the central axis $A_E$. Suitable interfaces are provided between corresponding input shafts and stems 36, which may for example be beveled gears. The vanes 30 may extend spanwise radially relative to the central axis $A_E$, as the case may be for vanes 30 provided in the compressor section 14 or in the turbine section 18, for example. In such cases, the vanes 30 are rotatably connected to a rotor shroud of the engine 10.

The coupling of the drive ring 50 and the rollers 60 is realized by one or more coupling means of the rolling contact joints 40B, one of which is provided in the form of flexible members 70, also referred to as ribbons, bands or compliant members, that tether the rollers 60 to the drive ring 50. Each one of the rollers 60 is tethered by a plurality of flexible members 70 that includes a first flexible member 70' and a second flexible member 70" that are respectively tensioned at least when the drive ring 50 rotates about the drive axis $A_D$ in a first direction of rotation (or first handedness) R1, and in a second direction of rotation (or second handedness) R2 opposite the first direction R1.

Figure 8:
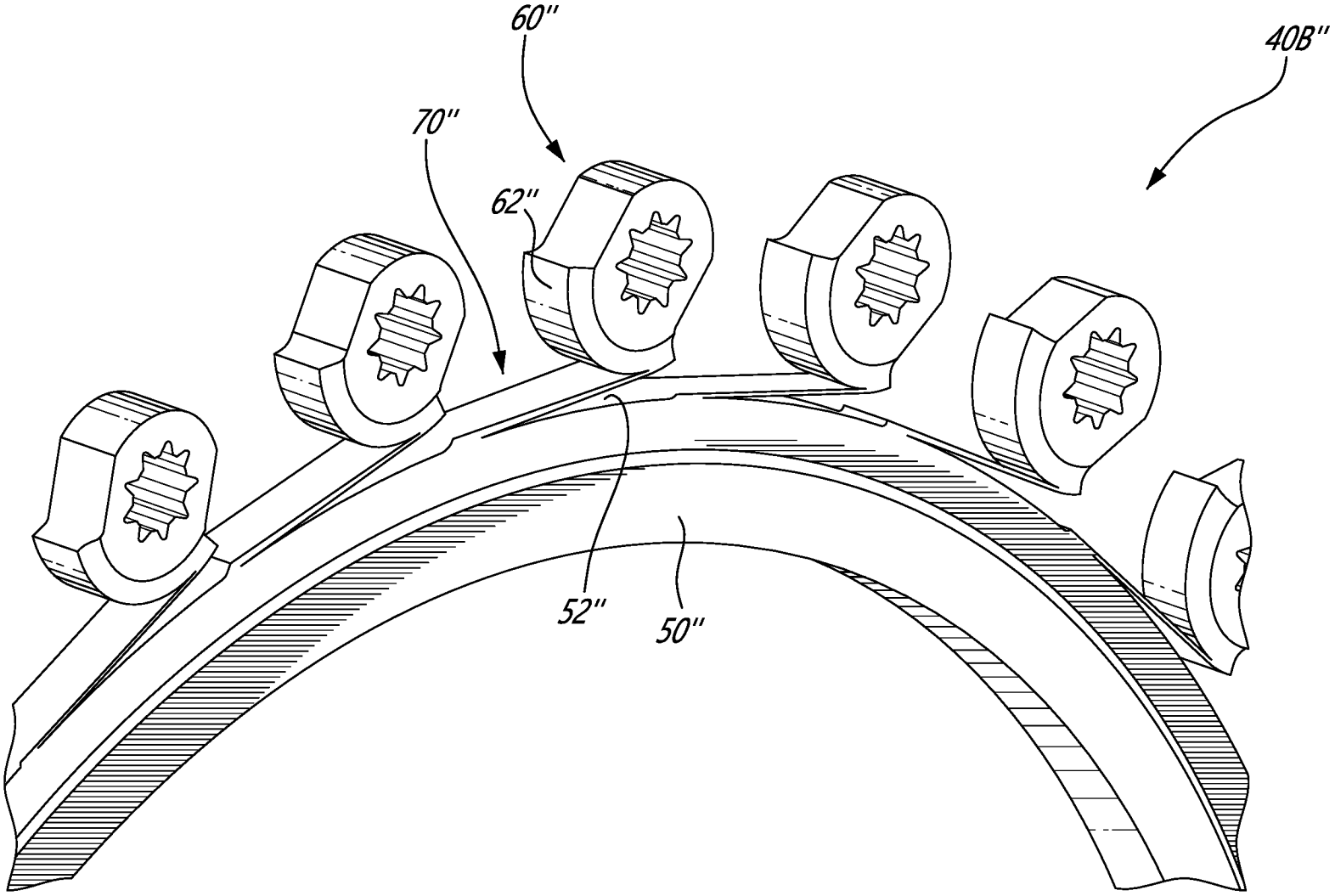
FIG. 8 is a perspective view of an inner portion of a variable guide vane control system according to another embodiment.
Figure 9:
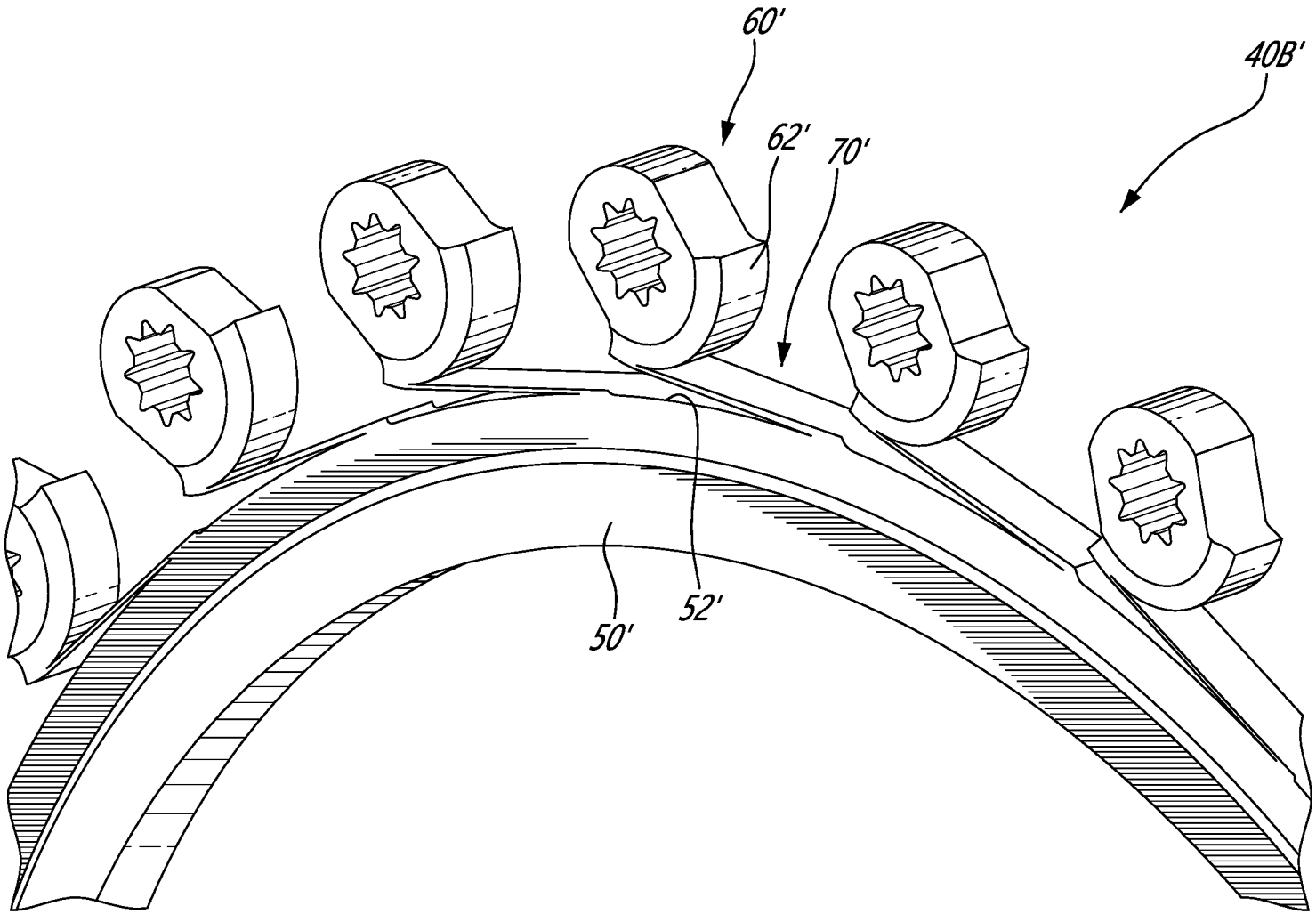
FIG. 9 is a perspective view of an outer portion of the variable guide vane control system of FIG. 8.

Each flexible member 70, or flexible member, is a strip of material that extends lengthwise between opposite ends respectively held stationary adjacent to a given roller 60 and to the drive ring 50 by a suitable means. Namely, the first flexible member 70' and the second flexible member 70" respectively have first and second ring ends 72', 72" and first and second roller ends 74', 74". Depending on the embodiment, the first and second ring ends 72', 72" are either mechanically attached (e.g., welded, brazed or fastened) to the drive ring 50 (FIGS. 2-7) or are integral therewith (FIGS. 8-9). Conversely, the first and second roller ends 74', 74" are either mechanically attached to their corresponding roller 60 (FIGS. 2-7) or are integral therewith (FIGS. 8-9).

By this tethered arrangement, rotational slippage of the drive ring 50 relative to the rollers 60, i.e., an amount of rotation of the drive ring 50 that would not concurrently induce an expected corresponding amount of rotation of one or more of the rollers 60, is eliminated or rendered negligible by the flexible members 70. Contrary to typical geared coupling arrangements in which a distance between adjacent land surfaces of meshed teeth results in backlash, i.e., a resulting distance that must be traveled by a driving tooth upon a change of direction of rotation thereof, the control system 40 is effectively backlash free, at least at the interfaces between the drive ring 50 and the rollers 60. Likewise, by this tethered arrangement, rotational slippage of the rollers 60 relative to the drive ring 50, which may otherwise occur in presence of airflow-induced vibratory loads on the vanes 30 for example, is eliminated or rendered negligible by the flexible members 70.

Hence, rotating the drive ring 50 about the drive axis $A_D$ in the first direction R1 immediately brings tension (or an increase in tension) in the first flexible member 70' tethered to a given roller 60 and immediately induces rotation of the corresponding vane 30 (in this case rotation toward the second vane position $\alpha_{v2}$). Conversely, rotating the drive ring 50 about the drive axis $A_D$ in the second direction R2 immediately brings tension (or an increase in tension) in the second flexible member 70" tethered to the given roller 60 and immediately induces rotation of the corresponding vane 30 (in this case rotation toward the first vane position $\alpha_{v1}$). Moreover, maintaining the drive ring 50 at a given ring position maintains the vanes 30 respectively at corresponding vane positions.

In some embodiments, the first flexible member 70' and the second flexible member 70" remain tensioned regardless of whether the drive ring 50 rotates or not, and regardless of the position the drive ring 50 and the rollers 60 are at within their respective range of positions. This may assist in eliminating any rotational play between the drive ring 50 and the rollers 60 regardless of loading conditions.

Each flexible member 70 is constructed so as to be resiliently flexible thicknesswise in order to at least partially wrap around the drive ring 50 or the corresponding roller 60 depending on the direction in which the drive ring 50 rotates. Yet, each flexible member 70 is sufficiently rigid lengthwise such that when placed under tension due to loads originating from the vanes 30 or from the actuator 40A, any lengthening of the flexible member 70 is negligible.

Figure 5:
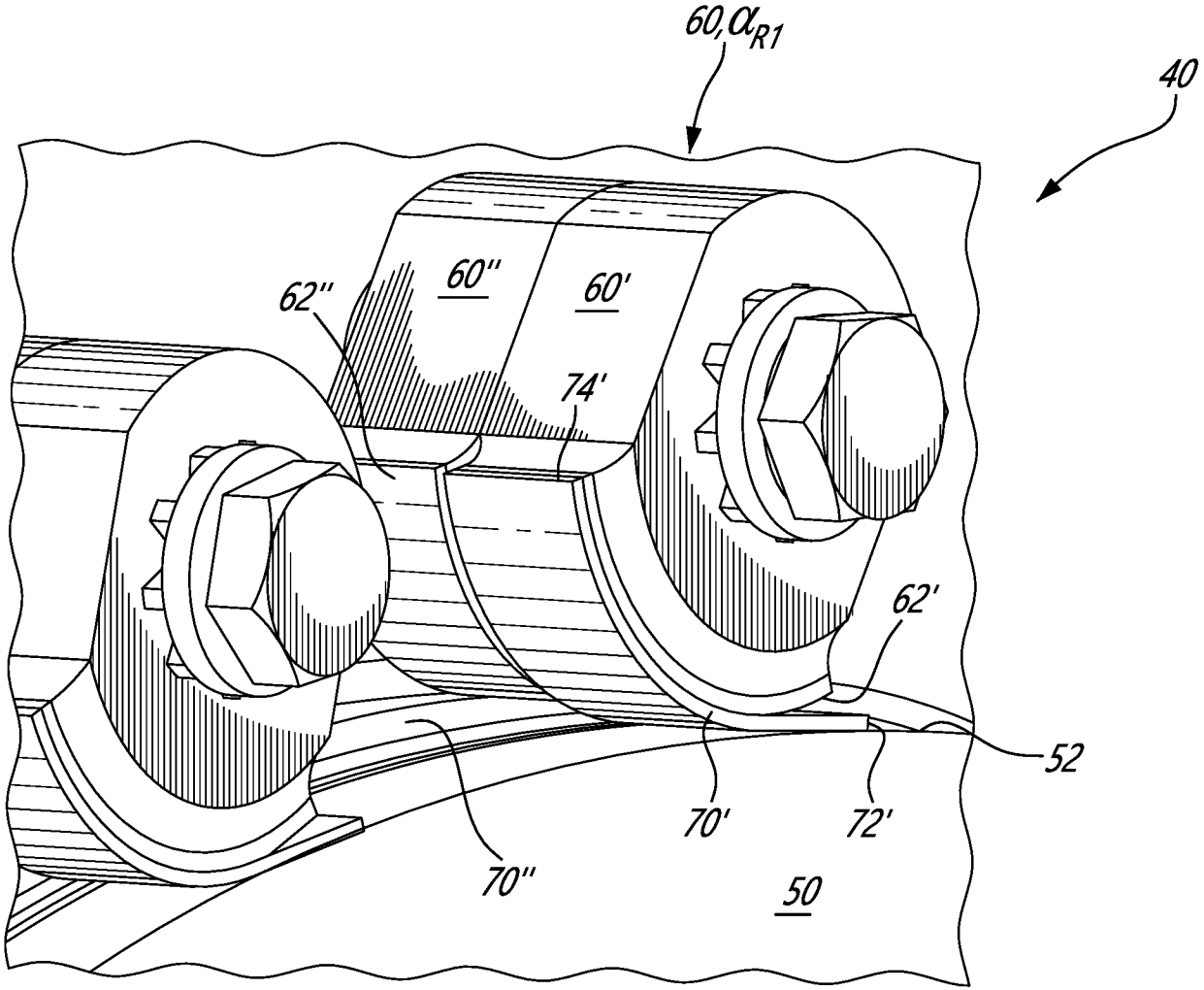
FIG. 5 is a close-up view of portions of the variable guide vane control system of FIG. 2.
Figure 6:
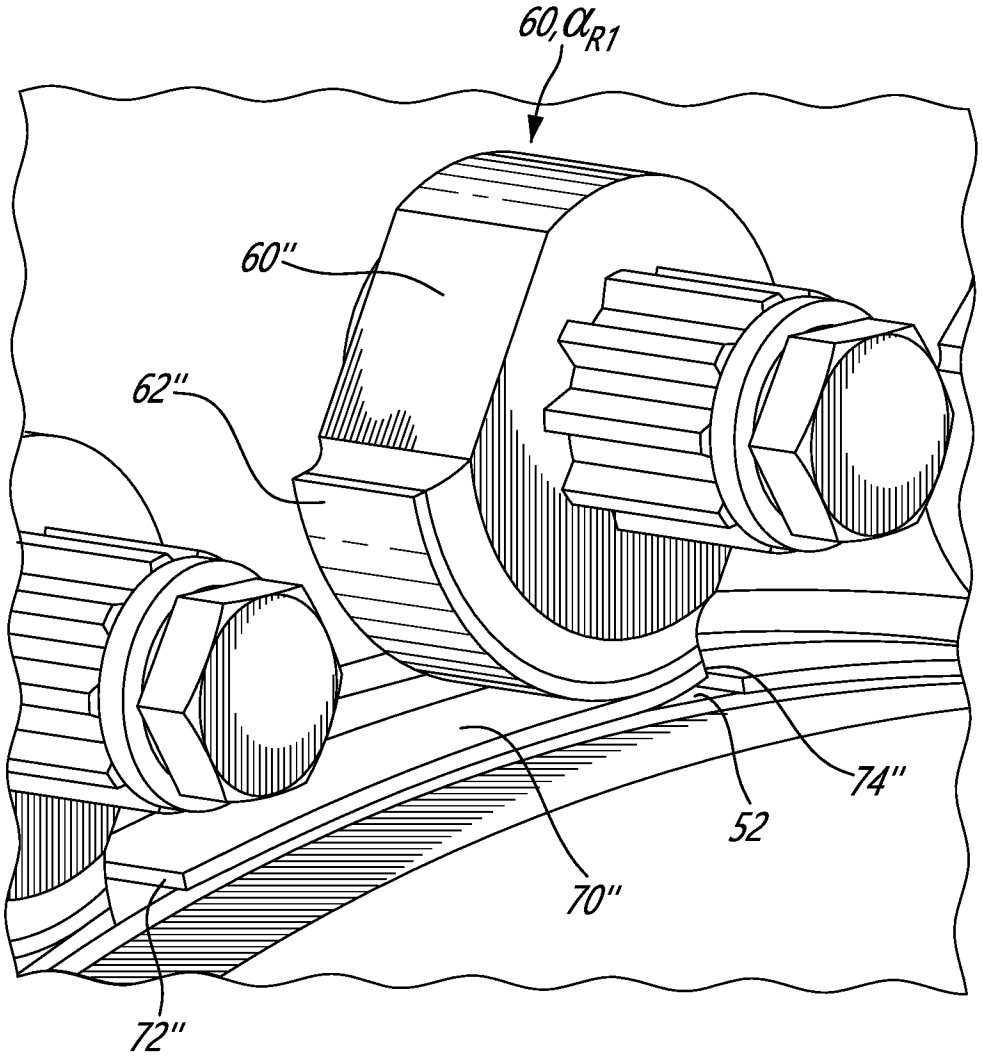
FIG. 6 is a close-up view of the portions of the variable guide vane control system of FIG. 5, an outer roller portion and an outer ribbon or flexible member thereof having been removed.

In FIGS. 2, 3, 5 and 6, the drive ring 50 is in the first ring position $\alpha_{D1}$ and the rollers 60 are in the first roller position am. In this first relative position, the first flexible members 70' are at least partially wrapped around their corresponding rollers 60, whereas the second flexible members 70" are at least partially wrapped around the drive ring 50. As best seen in FIG. 5, a portion of the first flexible member 70' proximate to the first ring end may be spaced from the roller 60. This portion may correspond to a length of the first flexible member 70' that is held against the drive ring 50. Conversely, as best seen in FIG. 6, a portion of the second flexible member 70" proximate to the second roller end may be spaced from the drive ring 50. This portion may correspond to a length of the second flexible member 70" that is held against the roller 60. In FIG. 4, the drive ring 50 is in the second ring position $\alpha_{D2}$ and the rollers 60 are in the second roller position $\alpha_{R2}$. In this second relative position, the second flexible members 70" are at least partially wrapped around their corresponding rollers 60, whereas the first flexible members 70' are at least partially wrapped around the drive ring 50. Rotating the drive ring 50 from the first ring position $\alpha_{D1}$ to the second ring position $\alpha_{D2}$ causes the first flexible members 70' to unwrap from their corresponding rollers 60 and to wrap around the drive ring 50, and causes the second flexible members 70" to unwrap from the drive ring 50 and to wrap around their corresponding rollers 60, and vice versa.

Figure 7:
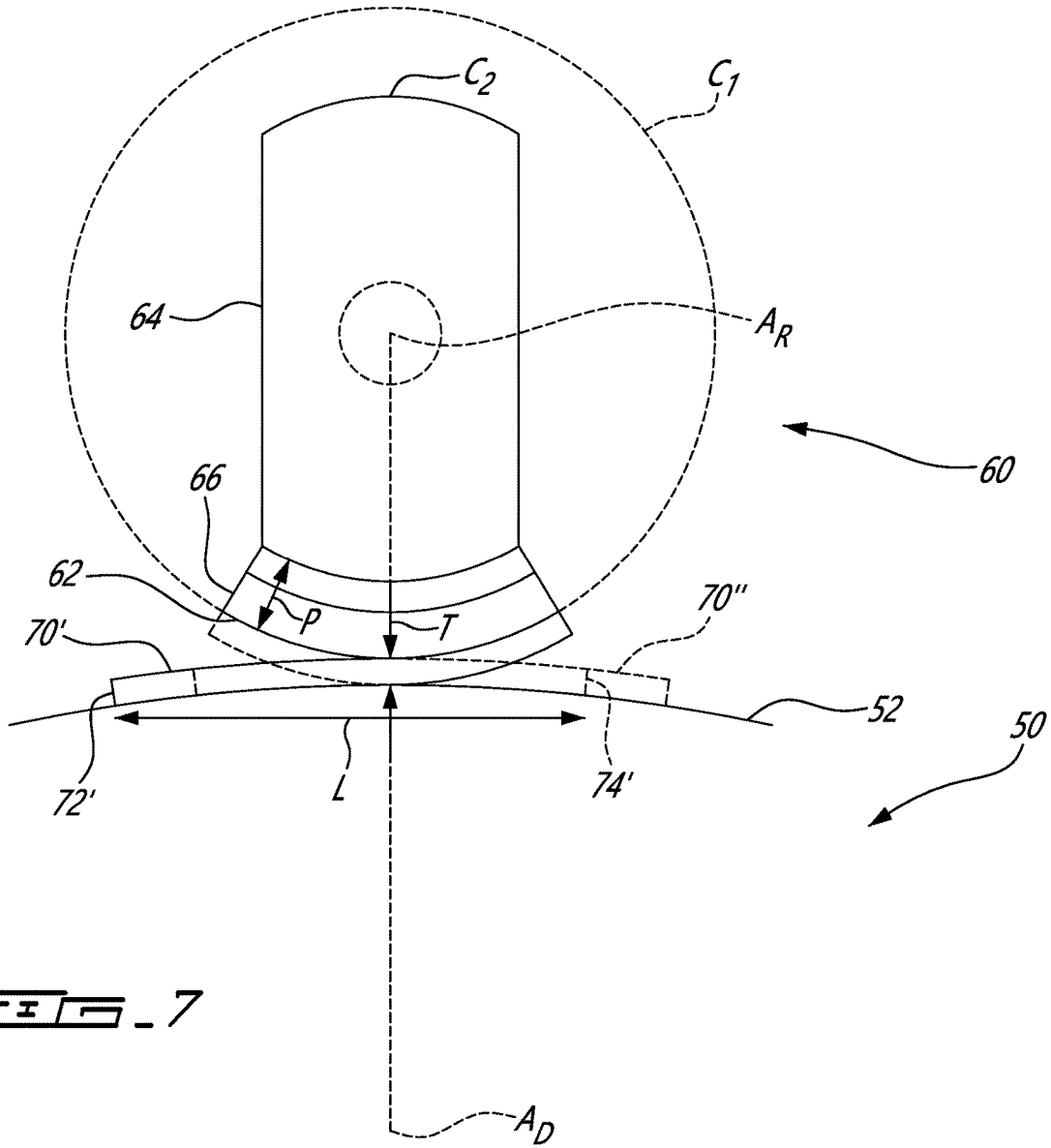
FIG. 7 is an elevation view of portions of the variable guide vane control system of FIG. 2.

In the embodiment depicted in FIGS. 2-7, the first and second ring ends 72', 72" are held at an outermost diameter of the drive ring 50 adjacent to the outer ring surface 52, and the first and second roller ends 74', 74" are held at an outermost diameter of the roller 60 adjacent to the outer roller surface 62. Moreover, as best seen in FIG. 7, the flexible members 70 extend thicknesswise radially outwardly relative to the drive axis $A_D$ from the outer ring surface 52 to the outer roller surface 62. Stated otherwise, a thickness T of the flexible members 70 fills a radial gap defined between the drive ring 50 and the rollers 60. In such embodiments, the drive ring 50 does not directly engage the rollers 60, and may be said to be indirectly coupled to the rollers 60 via the flexible members 70.

The outer roller surface 62 is circumscribed by an outer roller circumference C1, and yet in this example extends circumferentially by a circumferential length that is less than the roller circumference C. A remainder, or hub 64, of the roller 60 is circumscribed by an inner roller circumference C2 that is smaller than the outer roller circumference C1. It should be noted that the circumferential length of the outer roller surface 62 may be equal to or less than a length L of either one of its corresponding flexible members 70. A free length of the flexible member 70 (i.e., a length of the flexible member 70 that is unattached to the drive ring 50) may in some embodiments correspond to the circumferential length of outer surface 62. The outer roller surface 62 is defined by an arcuate pad 66 that projects radially from the hub 64 relative to the roller axis $A_R$ so as to define a pad thickness P. Various shapes are contemplated for the rollers 60, so long as the outer roller surface 62 is arcuate. Depending on the implementation, the range of vane positions may be set by providing the rollers 60 with a suitable pad thickness P. For instance, increasing the pad thickness P (and spacing the rollers 60 radially outwardly relative to the drive axis $A_D$ by a corresponding distance) increases an effective radius of the rollers 60, which decreases the range of vane positions and decreases the rate at which the rollers 60 rotate for each degree of rotation of the drive ring 50. Decreasing the pad thickness P (and bringing the rollers 60 radially inwardly relative to the drive axis $A_D$ by a corresponding distance) decreases the effective radius, which increases the range of vane positions and increases the rate at which the rollers 60 rotate for each degree of rotation of the drive ring 50.

It is contemplated however that the location at which the flexible members 70 meet the drive ring 50 and the rollers 60 may vary depending on the embodiment. For instance, the flexible members 70 may be recessed relative to the outer ring surface 52 and/or the outer roller surfaces 62, such that the outer ring surface 52 and the outer roller surfaces 62 may engage one another. Such an arrangement may be referred to as a secondary coupling means of the rolling contact joints 40B, whereby friction between the outer ring surface 52 and the outer roller surfaces 62 assists in transmitting rotation from the drive ring 50 to the rollers 60.

Referring to FIGS. 8 and 9, the drive ring 50 is formed of first and second ring portions 50', 50" respectively having first and second outer ring surfaces 52', 52", and the rollers 60 are respectively formed of first and second roller portions 60', 60" respectively having first and second outer roller surfaces 62', 62". The first ring portion 50', the first flexible members 70' and the first roller portions 60' together form a first integral rolling contact joint 40B', whereas the second ring portion 50", the second flexible members 70" and the second roller portions 60" together form a second integral rolling contact joint 40B". The first and second integral rolling contact joints 40B', 40B" are to be mounted side by side, such that the ring portions 50', 50" are paired to be simultaneously driven by the actuator 40A and corresponding roller portions 60', 60" are paired to simultaneously drive a corresponding vane 30. It is also contemplated that in some embodiments, an integral rolling contact joint 40B may be provided, in which a sole drive ring 50 is tethered to unitary rollers 60 by way of integrally-formed flexible members 70.

Among the various suitable manufacturing methods contemplated, additive manufacturing may be used, for example to produce rolling contact joints 40B having flexible members 70 that are integral to the drive ring(s) 50 and/or to the rollers 60.

All of the above described embodiments provide for a method of controlling rotation of at least one vane about a vane axis, wherein the method comprises: rotating a drive ring about a drive axis; transmitting a rotation of the drive ring to at least one roller radially outward of the drive ring and rotatable about a roller axis parallel to the drive axis to rotate the at least one roller about the roller axis; transmitting a rotation of the at least one roller to the at least one vane to rotate the at least one vane about the vane axis; and opposing backlash between the transmitting the rotation of the drive ring to the at least one roller and the transmitting rotation of the at least one roller to the at least one vane. The opposing of the backlash may include tensioning at least one flexible member tethering the drive ring and the at least one roller to one another. The opposing of the backlash may include maintaining a correspondence between respective orientations of a plurality of vanes including the at least one vane relative to a gas path of an engine.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, more than one first flexible member 70' or more than one second flexible member 70" may be provided among the flexible members 70 of a given rolling contact joint 40B. Flexible members 70 may all have a same width, or may be sized differently. For instance, in an exemplary rolling contact joint 40B having a sole inner flexible member 70 disposed between two outer flexible members 70 (i.e., a sole second flexible member 70" between two first flexible members 70', or vice versa), the inner flexible member 70 may have a width that is greater than that of the outer flexible members 70. Yet further modifications could be implemented by a person of ordinary skill in the art in view of the present disclosure, which modifications would be within the scope of the present technology.

The invention claimed is:

1. A variable guide vane control system for a turbine engine having at least one vane rotatable about a vane axis, comprising:

an actuator; and a rolling contact joint including:

a drive ring rotatable about a drive axis and rotatably coupled to the actuator, at least one roller rotatable about a roller axis parallel to the drive axis and drivingly connectable to the at least one vane, and a first flexible member and a second flexible member tethering the drive ring and the at least one roller to one another, the first flexible member and the second flexible member respectively tensioned when the drive ring rotates about the drive axis in a first direction and in a second direction opposite the first direction.

2. The variable guide vane control system of claim 1, wherein the first flexible member extends circumferentially in the second direction from a first ring end held relative to the drive ring to a first roller end opposite the first ring end held relative to the at least one roller, and the second flexible member extends circumferentially in the first direction from a second ring end held relative to the drive ring to a second roller end opposite the second roller end held relative to the at least one roller.

3. The variable guide vane control system of claim 2, wherein the first and the second ring ends are mechanically attached to the drive ring and/or the first and the second roller ends are mechanically attached to the at least one roller.

4. The variable guide vane control system of claim 2, wherein the drive ring has an outer ring surface, the first and the second ring ends being held adjacent to the outer ring surface, and the at least one roller has an outer roller surface, the first and second roller ends being held adjacent to the outer roller surface.

5. The variable guide vane control system of claim 4, wherein the outer roller surface is circumscribed by a roller circumference, the outer roller surface having a circumferential length that is less than the roller circumference.

6. The variable guide vane control system of claim 5, wherein the first and second flexible members respectively have a first and a second flexible member length respectively defined between the first ring end and the first roller end and between the second ring end and the second roller end, the circumferential length of the outer roller surface being equal to or less than either one of the first and the second flexible member length.

7. The variable guide vane control system of claim 4, wherein the outer roller surface is spaced radially outwardly from the outer ring surface relative to the drive axis, and the first flexible member and the second flexible member extend thicknesswise from the outer ring surface to the outer roller surface.

8. The variable guide vane control system of claim 7, wherein the drive ring is rotatable about the drive axis between a first ring position and a second ring position to rotate the at least one vane about the vane axis between a first vane position and a second vane position, the first flexible member and the second flexible member respectively wrapping around the outer ring surface and the outer roller surface when the drive ring is rotated toward the first ring position, and the first flexible member and the second flexible member respectively wrapping around the outer roller surface and the outer ring surface when the drive ring is rotated toward the second ring position.

9. The variable guide vane control system of claim 1, wherein the first and second flexible members are integral to the drive ring and/or to the at least one roller.

10. The variable guide vane control system of claim 1, wherein the at least one roller includes a plurality of roller portions disposed side by side along the roller axis and respectively tethered to the drive ring by a corresponding flexible member of the first flexible member and the second flexible member.

11. A turbine engine comprising:

a duct defining a gas path;

at least one vane rotatably connected relative to the duct so as to extend in the gas path and be rotatable about a vane axis between a first vane position and a second vane position relative to the gas path;

an actuator; and a rolling contact joint including:

a drive ring rotatable about a drive axis and rotatably coupled to the actuator, at least one roller rotatable about a roller axis parallel to the drive axis and drivingly connected to the at least one vane, and a first flexible member and a second flexible member tethering the drive ring and the at least one roller to one another, the first flexible member and the second flexible member respectively tensioned when the drive ring rotates about the drive axis in a first direction and in a second direction opposite the first direction.

12. The turbine engine of claim 11, wherein the duct is an inlet duct and the vane axis is parallel to the drive axis.

13. The turbine engine of claim 11, wherein the duct is a rotor shroud and the vane axis is at an angle relative to the drive axis.

14. The turbine engine of claim 11, wherein the first flexible member extends circumferentially in the second direction from a first ring end held relative to the drive ring to a first roller end opposite the first ring end held relative to the at least one roller, and the second flexible member extends circumferentially in the first direction from a second ring end held relative to the drive ring to a second roller end opposite the second roller end held relative to the at least one roller.

15. The turbine engine of claim 14, wherein the drive ring has an outer ring surface, the first and the second ring ends being held adjacent to the outer ring surface, and the at least one roller has an outer roller surface, the first and second roller ends being held adjacent to the outer roller surface.

16. The turbine engine of claim 15, wherein the outer roller surface is spaced radially outwardly from the outer ring surface relative to the drive axis, and the first flexible member and the second flexible member extend thicknesswise from the outer ring surface to the outer roller surface.

17. The turbine engine of claim 16, wherein the drive ring is rotatable about the drive axis between a first ring position and a second ring position to rotate the at least one vane about the vane axis between a first vane position and a second vane position, the first flexible member and the second flexible member respectively wrapping around the outer ring surface and the outer roller surface when the drive ring is rotated toward the first ring position, and the first flexible member and the second flexible member respectively wrapping around the outer roller surface and the outer ring surface when the drive ring is rotated toward the second ring position.

18. A method of controlling rotation of at least one vane about a vane axis, the method comprising:

rotating a drive ring about a drive axis;

transmitting a rotation of the drive ring to at least one roller radially outward of the drive ring and rotatable about a roller axis parallel to the drive axis to rotate the at least one roller about the roller axis;

transmitting a rotation of the at least one roller to the at least one vane to rotate the at least one vane about the vane axis; and tensioning a first flexible member and a second flexible member tethering the drive ring and the at least one roller to one another, the first flexible member and the second flexible member respectively tensioned when the drive ring rotates about the drive axis in a first direction and in a second direction opposite the first direction.

19. The method of claim 18, comprising: maintaining a correspondence between respective orientations of a plurality of vanes including the at least one vane relative to a gas path.

* * * * *